United States Patent [19]

Vivion

[11] 4,216,904

[45] Aug. 12, 1980

[54] DEVICE FOR FASTENING A RAILWAY TRACK ON SLEEPERS DISPOSED END TO END

[76] Inventor: Robert Vivion, 38 rue George V, Eaubonne, France, 95600

[21] Appl. No.: 817,484

[22] Filed: Jul. 20, 1977

[30] Foreign Application Priority Data

Jul. 23, 1976 [FR] France ..... 76 22586

[51] Int. Cl.[2] ..... E01B 3/38

[52] U.S. Cl. ..... 238/25; 238/117; 238/282; 238/283; 238/310; 238/338

[58] Field of Search ..... 238/24, 25, 42, 83, 238/84, 85, 109, 115, 116, 117, 265, 313, 338, 343, 250, 282, 283, 310

[56] References Cited

U.S. PATENT DOCUMENTS

| | | | |
|---|---|---|---|
| 450,686 | 4/1891 | Taylor et al. | 238/338 |
| 1,020,973 | 3/1912 | Frisholm | 238/265 |
| 1,042,255 | 10/1912 | Gorman | 238/265 |
| 2,719,676 | 10/1955 | Prater | 238/24 |
| 3,039,695 | 6/1962 | Harmsen | 238/117 |
| 3,223,328 | 12/1965 | Moses et al. | 238/349 |
| 3,289,941 | 12/1966 | Sonneville | 238/116 |
| 3,387,781 | 6/1968 | Moses et al. | 238/25 |
| 3,870,231 | 3/1975 | Toyama et al. | 238/349 |

FOREIGN PATENT DOCUMENTS

| | | | |
|---|---|---|---|
| 861929 | 1/1971 | Canada | 238/84 |

*Primary Examiner*—John J. Love
*Assistant Examiner*—Ross Weaver
*Attorney, Agent, or Firm*—Brisebois & Kruger

[57] ABSTRACT

A railway track in which a rail is supported within a groove of a rail bed. The groove has outwardly sloping shoulders each spaced from the sides of the rail. Continuous clamps extend along each side of the rail. The clamps are secured by spaced apart hold-down assemblies positioned vertically between the clamps and the respective sloping shoulders to secure the track against both vertical and lateral movement. Elastic material pads completely isolate a rail from both the bed and the clamps.

12 Claims, 5 Drawing Figures

DEVICE FOR FASTENING A RAILWAY TRACK ON SLEEPERS DISPOSED END TO END

One knows that rails of a railway track of the conventional type are fastened on ties which generally rest on a railway roadbed by means of a certain thickness of ballast. The layer of ballast has essentially as its function to distribute on the roadbed, the load transmitted by the rail, and to offer of sufficient resistance to the displacement of the track. However, following repeated forces to which they are submitted, the ballast and the roadbed undergo deformations and, to maintain the geometrical characteristics of this type of track, it is necessary to periodically carry out maintenance operations, consisting of particularly truing-up and leveling the track and/or replacing the defective connections.

These repairs are costly because they require considerable and qualified labor. In addition, they are sometimes difficult to accomplish, particularly in the case of structures of the art, for example, a tunnel, by reason of the narrowness of the structure. To attempt to reduce the maintenance expenses, one has proceeded to a highly efficient mechanization of maintenance work. However, mechanical engines are not always useful on railway tracks with heavy traffic, for their use can lead to significant traffic interruptions. In addition, maintenance operations of tracks become more and more frequent under the combined effect of several factors, in particular, the very high speeds attained by modern day trains and the placing in use of heavier and heavier trains which can follow one another at short intervals due to improved means for control and surveillance of the traffic flow. Under these conditions, the operations are not only more frequent but also more critical to achieve without proceeding to traffic tie-ups.

To these problems inherent to railway tracks, are added the problems due to the environment. One knows, in effect, that taking account of the phenomena of urban concentration, railway tracks are finding themselves more and more surrounded by dwellings, and research has been undertaken to limit the noise and the propagation of vibrations caused by the passing trains. Up to now, this research has only produced limited results particularly because of the high cost.

To reduce the number of interruptions necessary for the maintenance of railway tracks of the classical type, it has already been proposed to replace the ballast with a very resistant track support such as a concrete slab. Various systems have been used. They necessarily comprise one or several flexible devices to replace the traditional flexibility of the wood tie and of the ballast.

They present all the advantages, however, several disadvantages always remain in particular, high production cost, difficulties in laying, difficulties in maintenance and later adjustment, and problems of noise and transmission of vibration.

Thus, U.S. Pat. No. 3,300,140 granted Jan. 24, 1967, describes a device for fastening railway tracks on longitudinal beams placed end to end which assures then an essentially continuous support for the rail. Between each rail and the line of longitudinal beams which supports it, is likewise provided a flexible pad insert extending essentially over the whole length of the rail. However, the two lines of beams are, in this known fastening system, joined between themselves by ties and clamps to form a rigid structure, which makes the beams not support each of the rails independently. Moreover, the rails are tied down to the beams in a discontinuous manner by means of regularly spaced connections, and the problem of noise and of vibrations is not resolved satisfactorily by this previous system.

The present invention has as its object to remedy the aforesaid disadvantages and to this effect, it proposes to realize a fastening arrangement which permits at the same time to bring a simple solution to the problem of noise and of vibrations and to reduce the frequency of maintenance work whatever type of track support is used.

The present invention has then as an object a system for fastening of railway track intended to be lain on a track support constituted, for example, by a foundation slab of concrete or a thickess of ballast resting on a roadbed, the system comprising for each row of rails, an essentially continuous rail bed on which the rails rest; a pad of flexible material of suitable thickness inserted between the rails and the rail bed which supports them, the pad being formed of elements placed end to end to constitute an essentially continuous surface, and fastening members to tie down the rails on the rail bed, characterized by the fact that on each rail bed and on both sides of the line of rails which is supported there, are disposed two clamps, each clamp being formed of elements placed end to end along the entire length of the rails to constitute an essentially continuous clamp, the fastening members securing the rails on the rail bed by means of the aforesaid clamps.

In a preferred embodiment of the system according to the invention, each rail bed on which a line of rails rests is formed by longitudinal beams placed end to end along the entire length of rails; the longitudinal beams each comprise at their upper part, a longitudinal groove, the bottoms of the grooves of the beams of each line of beams being situated as an extension of each other, the flexible pad being inserted between each rail flange and the bottom of the grooves of the beams, the two clamps being likewise inserted in the said grooves; the shoulders defining each groove of the beams are in planes essentially parallel to the axis of the beam and forming between them a small angle opening upwardly; each clamp takes support on the rail flange by means of a lining of flexible material, the said lining being formed of elements placed end to end along the entire length of the rails; each clamp is an angle-iron defining a concave curve facing the rails; the fastening members are clips (mooring-clamps) each applied against one of the clamps by a fastening bolt whose head is retained in the corresponding beam, the cross-section of the contact of the clips with the clamps corresponding to the exterior cross-section of the clamps; each clip takes support, by its surface opposite to that which is in contact with the clamp that it fastens, against one of the two shoulders which defines the groove of the corresponding beam; the lining is made preferably of a flexible material indentical to that of the pad; the width of the pad corresponds appreciably to the width of the rail flange; the pad and/or the linings of each rail are formed by the superimposition of two identical strips of elastic material, for example of neoprene, each strip comprising a succession of grooves and of ribs, the ribs of a strip being put in place in the grooves of the other and not filling up the grooves; superimposed sheets whose width corresponds approximately to that of the rail bed are interposed under the pad to insure the vertical adjustment of each rail; chocks are inserted between the shoulder of the grooves of the beams and the corresponding clips to assure the transverse adjustment of each rail; the beams are made of reinforced concrete; each beam comprises two anchoring casings with fastening bolts, extending transversely to emerge on the two longitudinal walls of the beam, each casing comprising two openings situated at right angles with two openings provided from casting, the aforesaid openings emerging into the groove on both sides of the location provided for the rail.

One sees that the securing of rails by the fastening device to be defined presents three essential characteristics; it is continuous, elastic and anti-vibrating. In effect, each rail is supported on its entire length by an essentially continuous rail bed, formed by longitudinal beams placed end to end. On the other hand, the fastening of the rail on the line of beams is realized by means of two clamps extending over the entire length of the rail. Being given that the rail is fastened tight over its entire length, the vibrations are considerably reduced in relation to devices of prior art in which the rail is constrained in a discontinuous fashion by means of regularly spaced connections. The elasticity of the fastening is procured at the same time, due to the pad of elastic material introduced under the rail flange and due to two linings, also of elastic material, which are each disposed between the rail flange and the corresponding clamp. The two linings and the pad completely isolate and insulate the rail respectively from the beams and from the clamps; one chooses, preferably, an elastic material presenting good characteristics for dampening vibrations.

Another advantage of the device according to the invention resides in the fact that it is made either of elements that are easy to fabricate such as longitudinal beams, or of elements already used to provide equipment for railway tracks, as anchor bolts with a specially adapted head in the form of a cam or sheets of vibration-resistant material constituting the pad and the linings of each rail.

The transverse adjustment of each of the rails is assured in a particularly simple fashion by adjustment blocks that one inserts between a shoulder of a groove and the corresponding clips. Likewise, the vertical adjustment of each of the rails is obtained by putting the adjustment sheets under the elastic pad. These sheets will be, preferably, the width of the rail bed: from this fact, the clips taking support on the adjustment sheets, will permit a uniform fastening of the rail.

One complementary arrangement permits eventually increasing the antivibration quality of the system in the case of placing it on concrete; it is a matter of interposing an elastic envelope between the concrete of the beam and the concrete of the roadbed. One will mention, in this regard, two possible solutions: in the first, this prefabricated envelope is placed in the mold at the time of casting of the beam, and is completely integral with the latter; in the second the beam is fit in this elastic envelope at the time of mounting of the track before pouring the fixing concrete. In this second solution, the envelope is called a "boot." This envelope constitutes the second elastic stage of the track.

In a first variation of the system according to the invention, the laying of the railway track is carried out on a foundation slab of concrete in which one beds longitudinal beams; the reinforced concrete beams have an appreciably rectangular upright cross-section and can have irons waiting to be projected from the lower part of their longitudinal borders.

One can state that, for the laying of the railway track on a concrete slab, each rail is fastened independently from the other. Being given that the rail is supported in a continuous fashion over its entire length, the mechanical constraints to which it is submitted are less, and consequently it is possible to reduce the cross-section of the rail. This type of laying is particularly advantageous in the case of a tunnel or similar structures of the art for it permits a reduction of the height between the roadbed and the rolling surface of the rails to then have a more essential overall structure for the material forming the tunnel. Moreover, for a given useful overall structure of a railway tunnel, one realized a substantial saving due to the reduction of the unused cross-section of the structure.

In a second variation of the system according to the invention, the laying of the railway track is carried out on a roadbed made of a certain thickness of ballast; the beams molded of reinforced concrete comprising, appreciably in their median zone, a transverse strap projecting laterally, a crossbar being bolted at its extremities on the two straps situated between two parallel beams to maintain the gauge of the track; it is likewise possible to improve the qualities of longitudinal and transversal stability of the track by the addition, at the time of moulding, of flanges to the lower part of the beam.

One sees that for this embodiment, the preservation of the gauge of the track on ballast is obtained by crossbars. After having proceeded to the placing of the beams according to the two parallel lines, one fixes the crossbars on the straps of the beams; one makes a fine complementary adjustment of the gauge by means of chocks inserted between the shoulder of the grooves of the beams, and the corresponding clips. This fastening device contributes a definite improvement in relation to equipping of traditional tracks using long welded rails with ties of reinforced concrete. In effect, the lateral surface presented by the beams being greater than that of the ties, the resistance of the track to transverse displacement is increased, this resistance being able to be improved by the addition of a longitudinal flange. As a consequence, the minimum admissible radius for the use of long curved welded rails can be reduced. In addition, the resistance to longitudinal displacement of the track is likewise increased due to the transverse rib provided on the lower surface of the beams. There results from this, less weakening of the ballast over a period of time, and consequently, a reduced frequency of interruption for leveling and for truing-up operations.

It is appropriate to emphasize that these two variations of an embodiment of the invention permit to resolve in a simple fashion the problem of noise and of the propagation of vibrations, which makes them most particularly usable for railway tracks in urban locations.

To better understand the objects of the invention, one will now describe, purely as a non-limiting example, two embodiments shown in the attached drawings.

Figure 1:
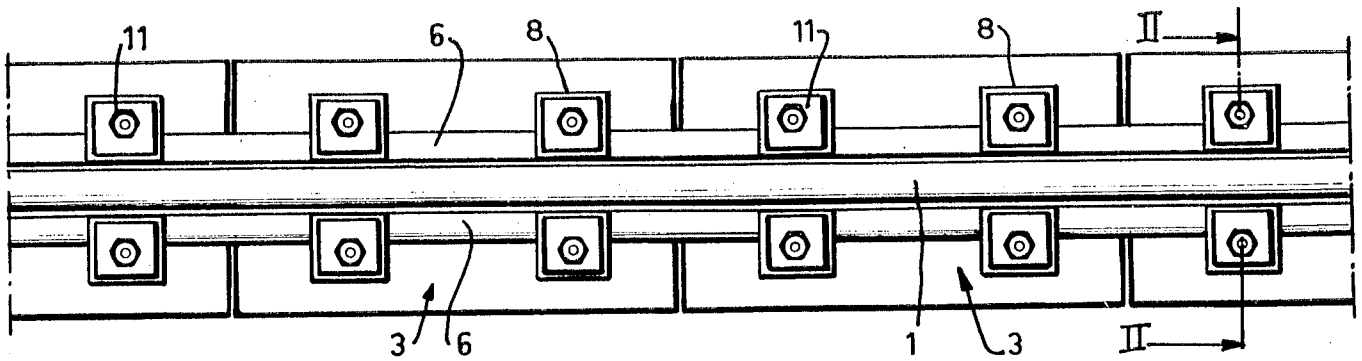
FIG. 1 shows a partial view in plan of an arrangement for fastening railway tracks on a foundation slab of concrete, this arrangement comprising longitudinal beams placed end to end along and below the entire length of the rail.
Figure 3:
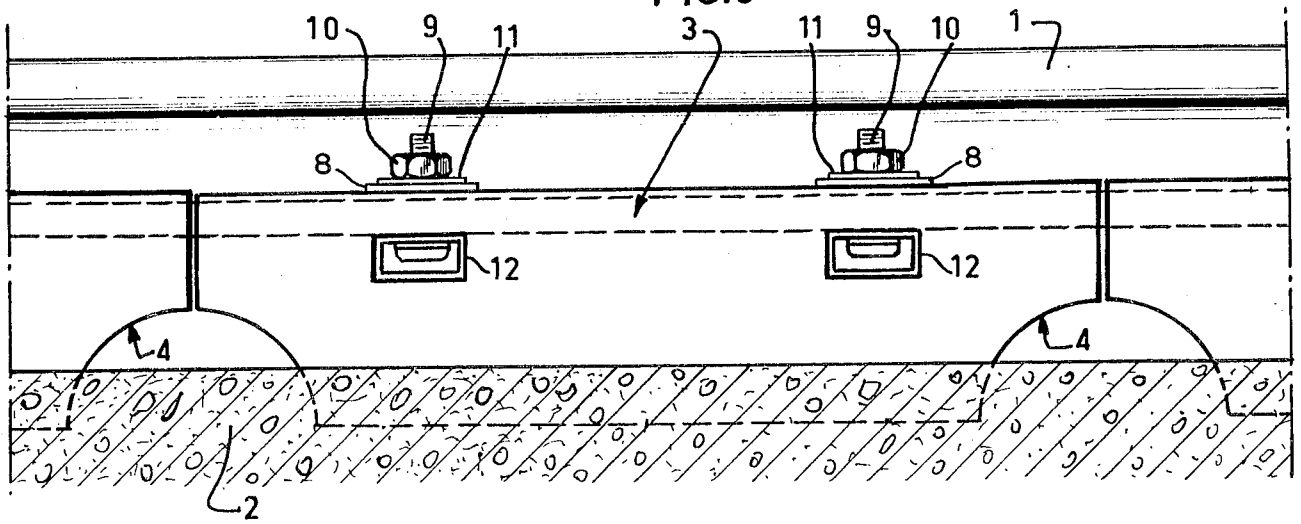
FIG. 3 shows a partial view in elevation of the fastening arrangement of FIG. 1.
Figure 2:
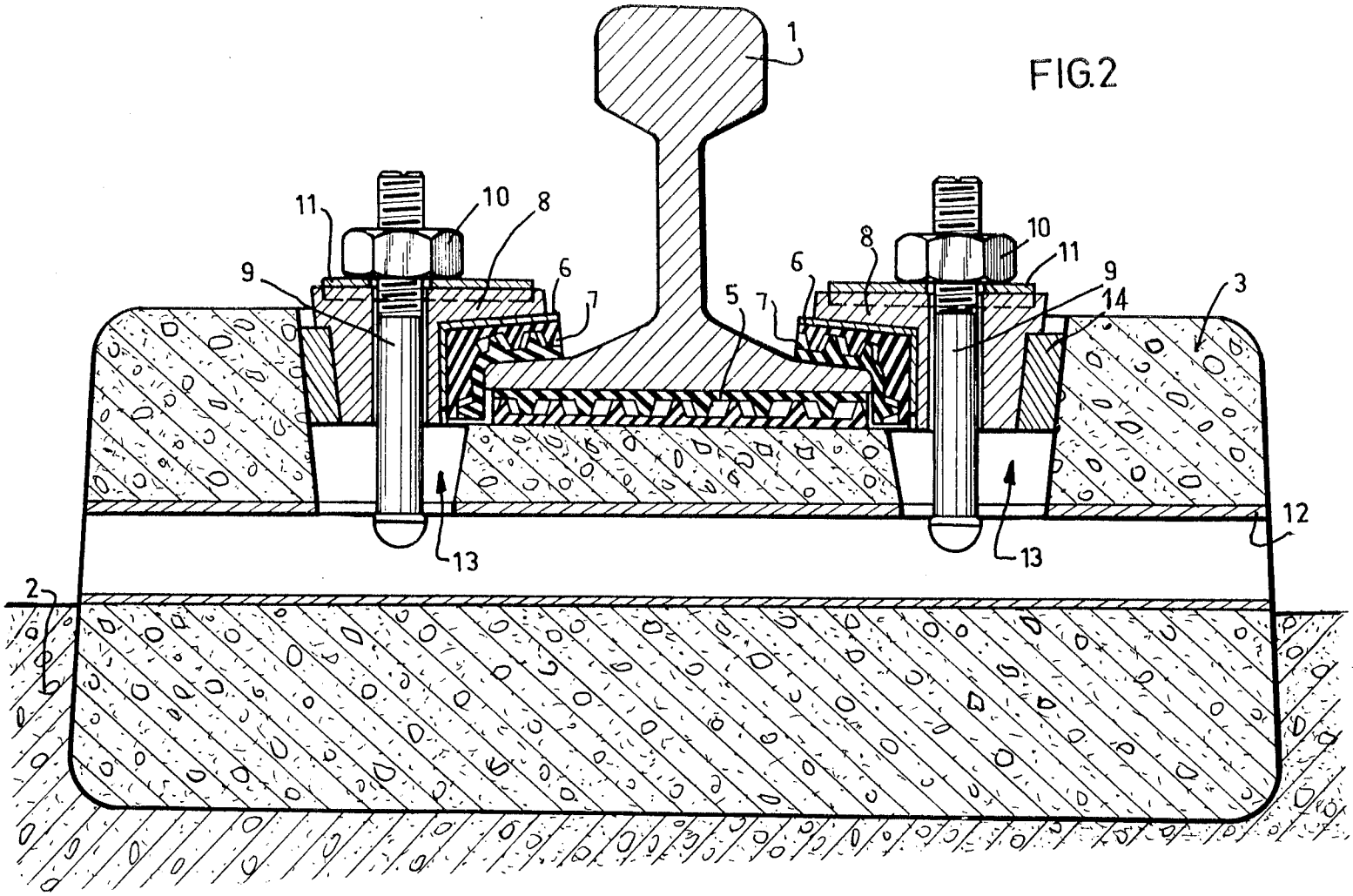
FIG. 2 shows in transverse section according to II—II, the fastening arrangement of FIG. 1.

Referring in particular to FIGS. 1 through 4, one sees designated by 1, a section of rail resting on a slab of concrete 2 by means of a line of longitudinal beams 3 placed end to end all along and under the rail. The other parallel rail of the railway track is made fast to the concrete slab by the same fastening members but they have not been shown.

The longitudinal beams 3 are made in conventional fashion by pouring of concrete around a reinforcement array disposed in a mould. Each element has the form of a compact flat piece of upright section essentially rectangular which measures 0.745 m in length for a thickness and outside width respectively of 0.20 m and of 0.47 m. The proportions of the beams can vary as a function of the type of track to be made; however, the beam length must not be too great in order on the one hand, to limit its weight and to facilitate its handling, and on the other hand, to permit its use on a curve.

At their lower part, the beams are bedded in the thickness of the foundation slab 2. Each beam can comprise at each of its extremities, either a recess defining with the contiguous beam a transverse cavity, or a transverse pipe bedded in the concrete of the beam, usable eventually to permit the flow of drain water or the passage of cables.

At their upper part, the beams 3 each contain a longitudinal groove resulting from moulding, of slightly trapezoidal upright section. The bottoms of the grooves of the line of beams 3 are disposed as prolongations of each other to constitute the rail bed of rail 1.

Between the rail flange and the rail bed, is inserted a continuous pad 5 of elastic material constituted by elements of any length whatever. The pad 5 can be made in a known fashion of two superimposed strips of neoprene, each strip comprising ribs separated by grooves, the ribs of one strip being inserted into the grooves of the other strip without completely filling the grooves. This material provides the required elasticity and it possesses good anti-vibration characteristics. The width of the pad corresponds essentially to that of the base of the rail and its thickness is in the order of 10 to 20 mm. The grooves shown in the drawings are disposed longitudinally but they can be placed transversely according to the technical characteristics to be obtained. The pad can likewise be made of any other flexible material whose anti-vibrational characteristics correspond to the criteria sought.

On each side of rail 1, are disposed two clamps 6 each constituted by sections of angle iron placed end to end along the length of the rail. The constituent angle irons of clamps 6, have appreciably the shape of an L defining a concave shape opposite the rail flange. Each clamp 6 takes support on the rail flange by means of a continuous intermediate lining 7 of elastic material, this lining being likewise obtained by placing lengths of strips of elastic material end to end. The lining 7 is folded against the rail flange and it covers appreciably the whole surface of the quarter circle curve defined by the clamp 6. The two linings 7 can be made of the same elastic material as the pad 5.

One observes that rail 1 is not in direct contact with either clamps 6 or beams 3 due to the interposition of the two linings 7 and of the pad 5. It can be observed that the rail is insulated since the constituent material of the pad and of the two linings has the property of being a good electrical insulator.

One of the essential characteristics of this arrangement is that the two clamps 6 associated with the two linings 7 assure a continuous and elastic pressure or fastening or rail 1 on beams 3 unlike related arrangements of the prior art. This fastening is obtained by means of hold-down clips 8 regularly spaced on both sides of the rail and which are disposed in the grooves of beams 3. Each beam 3 has four clips which are each secured on its rail bed by an anchor bolt 9 whose head is retained in the beam. Clips 8 take support, on the one side against the oblique shoulder defined by the groove and on the other side, on the corresponding clamp 6. The contact profile of clips 8 with clamp 6 assumes the concave shape of the exterior profile of the clamp.

To the side of a clip 8, the exterior profile of the clamp 6 is almost entirely covered by the profile of the clip. The sections of angle iron placed end to end to constitute the clamps 6 are disposed in such a way that their junction takes place at clips 8.

One advantage of the device according to the invention is that the anchor bolts 9 can be easily replaced in case of damage. To do this, one provides two anchor casings 12 bedded in the lower area of each beam 3; these casings extend transversely and pass at their extremities to the two longitudinal walls of the element. Two holes 13 of sufficient diameter, which emerge onto the rail bed on both sides of the location provided for rail 1 above each anchor shaft 12 are made during casting. Before placing clips 8, one introduces bolts 9 in the appreciably rectangular opening in each casing at right angles with the two hollows 13 and after a rotation of 90°, it is possible to immobilize the cam shaped head of bolts 9 inside of each shaft 12. The bodies of the bolts 9 go through clips 8 and project above the latter; a nut 10 is screwed on the threaded extremity of each bolt 9 and takes support on the corresponding clip by means of a bearing plate 11 of steel. The four anchor bolts 9 of each element 3 are thus easily unmounted.

The fastening arrangement now to be described permits a particularly convenient transverse and vertical adjustment of each rail 1: the transverse adjustment is effected by inserting chocks 14 between the oblique shoulder of the groove and clips 8; the eventual adjustment in height is obtained by the interposition of small juxtaposed spacer sheets or plates of slight thickness (not shown) between pad 5 and the rail bed. For this latter adjustment, the adjusting sheets will be advantageously cut according to the width of the bed of rail 1. In this manner, the clips 8 take support on these sheets assuring a uniform fastening; the vertical adjustment thus permitted attains 20 mm or more if necessary.

In addition to the characteristics of continuous fastening, anti-vibrational and elastic, which this rail fastening device provides on concrete platforms, it is fitting to remark that the shoulders of the groove constitute the lateral stops for the clips 8, which contributes to give to the device of the invention a good stability against transverse forces exerted by rolling vehicles at high speeds. This fastening arrangement, in addition to being analogous to devices for rail without ballast, presents also the advantage of assuring the maintenance of the geometrical characteristics of the rails over a period of time and the almost total elimination of maintenance operations. Beams 3 of reinforced concrete are easily mouldable because of their structure and their particularly simple geometry. Moreover, the fabrication tolerances are greatly reduced for they apply only to the dimensioning of the groove, that is to say, the two oblique shoulders forming the lateral stops and the rail bed.

Figure 4:
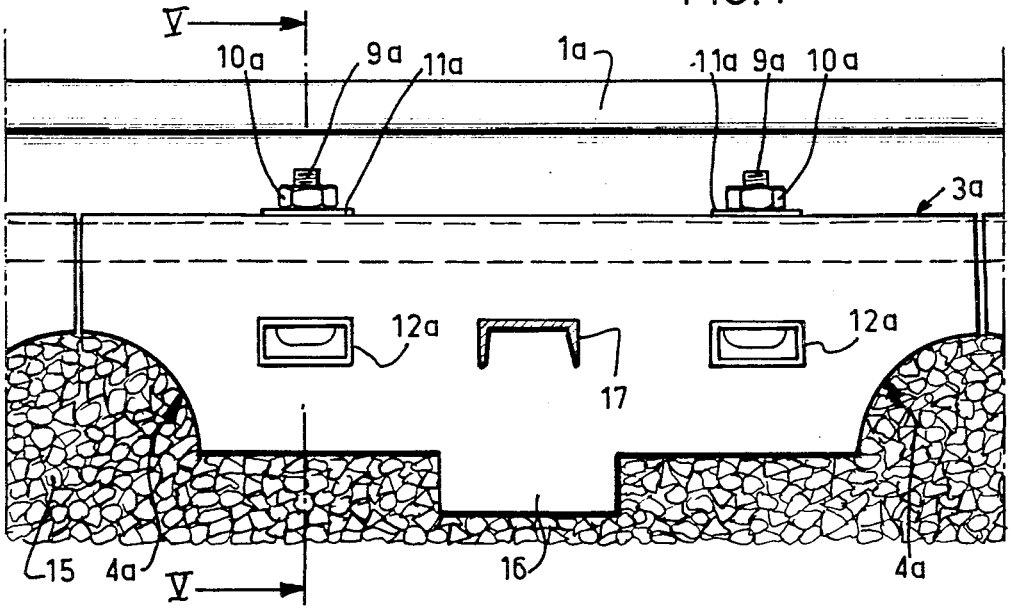
FIG. 4 shows a partial view in elevation of another fastening arrangement for railway track on ballast.
Figure 5:
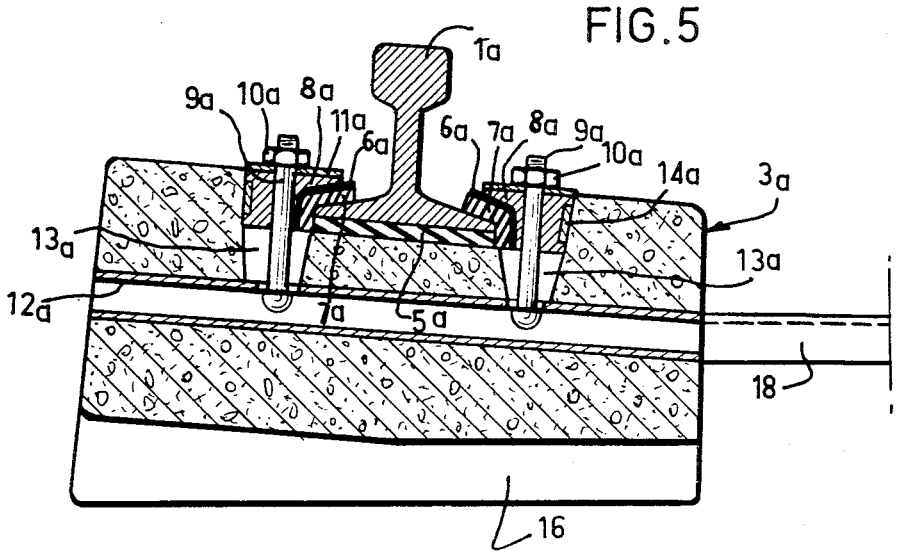
FIG. 5 shows a transverse section according to V—V of the fastening arrangement of FIG. 4.

Referring now to FIGS. 4 and 5, there is shown a second variation of the device for fastening a rail on ballast. One observes that one finds essentially all the elements previously described for the embodiment of FIGS. 1 to 3; the essential differences between this last embodiment and the embodiment of FIGS. 4 and 5 are on the one hand, the different shape of the lower region of the beams and on the other hand, the addition of a lateral connector or strap sealed in the beams, permitting the fastening of crossbars between the two lines of beams; the other elements are identical in these two embodiments; in FIGS. 4 and 5, one has consequently provided elements corresponding to those of FIGS. 1 to 3, with the same references followed by the index a.

One finds a rail 1*a* resting on the rail bed formed by the bottom of longitudinal grooves made in beams 3*a*; a pad 5*a* inserted under the rail flange; and two clamps 6*a* disposed on both sides of the rail 1*a* and which take support on the rail flange by means of a lining 7*a* made of a material identical to that used for pad 5*a*. The fastening members of the two clamps 6*a* upright in each element 3*a* are constituted likewise by four clips 8*a* which are fixed on the beam 3*a* by means of four anchor bolts 9*a* whose heads in the shape of a cam are immobilized in the two anchor casings 12*a*. Bolts 9*a* are disposed inside the holes 13*a* produced during moulding and through the thickness of clips 8*a* to project above the latter. Nuts 10*a* are screwed into the threaded extremities of bolts 9*a* and they are fastened against the clips 8*a* by means of load distributing plates or washers 11*a*.

One observes that the beams 3*a* are put in place on a bed of ballast 15 and that they each comprise a transverse flange 16 with a rectangular section, extending over the entire width of the beam 3*a*. This flange 16 is situated appreciably in the median transverse plane of the beam and it unites in contact with the ballast by its lower side. Each beam 3*a* contains a strap 17 situated appreciably in its median transverse plane, and which projects between the two rails 1*a* of the railway track. This strap 17 previously welded to the frame is embedded in the concrete at the time of moulding the beams. Crossbars 18 disposed between the two rails 1*a* are fixed at their extremities on straps 17 to assure the maintenance of the gauge of the track. This operation is effected after the placement on the ballast 15 of beams 3*a* in two parallel lines, a fine complementary adjustment of the two rails being made by means of chocks 14*a*. It is fitting to note that these beams can be used without modification whatever be the desired gauge of the railway track; only the crossbars must have a different length.

The two arrangements which will be described can advantageously be adapted, for example, in the laying of rails with a drive current rail or third rail, a device that one generally finds on metropolitan railways. In this case, beam 3 or 3*a* and the insulating rail bed disposed in overhang can be advantageously moulded in a single part. A second possibility consists in engaging inside each anchor shaft a section that one fastens then to it to sustain the support of the insulator.

It is clear that the beams can be made of a material other than reinforced concrete for example, of plastic material or in the form of a simple metal reinforcing frame intended to be sealed in a slab of concrete for the laying of the railway track in structure of the art, which permits a gain in height. Another characteristic of the fastening arrangement comprises favoring the sliding of the rail in relation to its support. The interposition of a material with low coefficient of friction in the fastening device permits this sliding. This disposition presents a certain interest, especially in and at the access to structures.

It is, of course, understood that the embodiments above described are in no way limiting and are able to give way to all desirable modifications, without going beyond the scope of the invention.

I claim:

1. A railway track support and fastening arrangement comprising, for each rail, a substantially continuous rail bed for supporting a rail of the track, said rail having a bottom face; said bed having a longitudinal groove presenting an upwardly facing support surface and sides presenting lateral shoulders outwardly sloping facing each other and on opposite sides of and spaced from a rail; a substantially continuous pad of elastic material within said groove and between said support surface and the bottom face of the rail; substantially continuous clamp means on each side of the rail for securing the rail vertically and transversely, each clamp means being within said groove and comprising a plurality of clamp elements in adjacent end to end relation along the length of the rail, a substantially continuous lining pad between each clamp means and the rail; said pads and said lining pads comprising means for isolating the rail from the rail bed and from the clamp means, fastener means within said grooves at each side of the track for fastening said clamp means to secure the rail vertically and transversely, said fastener means comprising a plurality of spaced apart hold down elements extending downwardly between said clamp means and a lateral sloping shoulder of the groove, said hold down elements being supported laterally by said sloping shoulder to retain the rail laterally, and means securing said hold down elements to the rail bed.

2. An arrangement according to claim 1, further comprising, chock means between selected ones of said hold down elements and said lateral shoulders for transversely positioning the rail in said grooves.

3. Arrangement according to claim 1, wherein the rail bed for each rail comprises longitudinal beams placed end to end along the length of the rails.

4. Arrangement according to claim 1, wherein each clamp element comprises an angle iron having a concave surface facing toward the rail.

5. Arrangement according to claim 1, wherein each hold down element comprises a clip, and the means securing the hold down elements comprise, a fastening bolt whose head is retained in the rail bed, the hold down elements directly engaging the clamp elements and having a contour conforming to the exterior contour of the clamp elements.

6. Arrangement according to claim 1, wherein said pad of each rail comprises two identical strips of elastic material, each strip comprising a succession of grooves and ribs, the ribs of one strip being positioned in the grooves of the other and filling less than the width of said grooves.

7. Arrangement according to claim 3 characterized by the fact that the beams are made of reinforced concrete.

8. Arrangement according to claim 7, wherein each longitudinal beam comprises two anchor casings extending transversely and extending through the two sides of the beam for receiving fastening bolts, each casing defining two openings situated at right angles to molded openings in the beam, said openings extending into the groove on both sides of the rail.

9. Arrangement according to claim 3, further comprising a foundation slab of concrete in which the longitudinal beams are sealed.

10. Arrangement according to claim 3, wherein said beams are supported by a layer of ballast.

11. Arrangement according to claim 10 further comprising a crossbar between an opposed pair of beams to maintain the gauge of the track.

12. Arrangement according to claim 10, wherein each beam has a lower surface comprising a transverse flange and a longitudinal flange, of rectangular section.

* * * * *